United States Patent [19]

Ewald et al.

[11] Patent Number: 4,936,584

[45] Date of Patent: Jun. 26, 1990

[54] TRAINING DEVICE FOR GOLFERS

[76] Inventors: David W. Ewald, 30 Perryridge Rd., Greenwich, Conn. 06830; Gary S. Worden, 500 Main St., Parkville, Mo. 64152

[21] Appl. No.: 362,362

[22] Filed: Jun. 7, 1989

[51] Int. Cl.[5] ..... A63B 69/36

[52] U.S. Cl. ..... 273/183 B; 273/DIG. 17; 273/199 R

[58] Field of Search ..... 273/414, DIG. 17, 183 B, 273/DIG. 30, 190 R, 190 A, 190 B, 188 R, 183 D

[56] References Cited

U.S. PATENT DOCUMENTS 4,248,435 2/1981 Barmore ..... 273/414

FOREIGN PATENT DOCUMENTS 1238985 7/1960 France ..... 273/DIG. 17

*Primary Examiner*—George J. Marlo

*Attorney, Agent, or Firm*—Staas & Halsey

[57] ABSTRACT

A golf taining device is mounted on the bill of a golfer's headpiece and is operable to provide clear evidence of improper head or neck movement during the golf swing, and foster coordinated rotational movement of shoulders, torso and hips. The device includes a ball and a base member consisting of a cup shaped ball carrying seat structure having a ball retaining wall having side walls of a reduced height but of a size and disposition to normally keep the ball in the seat structure even during the address of a ball to be struck and during a correct swing. The ball is tethered to the base member by a flexible cord and the wall is of insufficient size to prevent movement of the ball out of the seat structure when the base member is moved or tilted in an accented way by improper head or neck movement during the golf swing. When the ball moves out of the seat structure it falls by gravity to dangle in front of the golfer's eyes to provide a clear indication of improper head or neck movement, including related improper shoulder, torso or hip rotational action.

7 Claims, 2 Drawing Sheets

TRAINING DEVICE FOR GOLFERS

BACKGROUND OF THE INVENTION

1. Field of the Invention

The present invention relates to the field of self training devices for golfers and in particular to such a device which is simple and easy to use and will readily indicate to a golfer that his or her head and/or neck have moved improperly during the golf swing, and/or that shoulders, torso and hips have not moved in a proper rotational manner.

2. The Prior Art Environment

The ability to properly execute the golf swing has been a much sought after skill for many years. Golfers spend much time and money seeking improvements in their game. Golf instructions are expensive and time consuming and sometimes futile exercises. Because of the continuing desire for improvement on the part of golfers, a number of devices for self training have been proposed. Some of these devices are illustrated in U.S. Pat. Nos. 1,459,705; 3,109,654; and 3,437,339 and in British Patent Specification No. 1,373,772.

While the devices illustrated in the prior patents are interesting, the quest for golf training devices which will facilitate self training continues. In particular, such a device should be uncomplicated in structure and should readily provide an indication to the golfer that the swing, or at least some critical portion thereof, has been improperly executed. In a major sense improper head and neck movement including related improper rotational movement of shoulders, torso and hips, is the particularly critical problem for most golfers and is an aspect of the overall golf swing which is difficult for the golfer himself to observe. Accordingly, golfers have sought and continue to seek a simple device which will immediately provide information that the swing just executed was accompanied by an improper movement of the head and neck and/or related lack of proper movement of shoulders, torso and hips. The present invention provides such a device.

SUMMARY OF THE INVENTION

The present invention provides a non-complicated, straight-forward golf training device capable of immediately indicating improper head and neck movements and/or uncoordinated shoulder, torso or hip turning, during the golf swing. The device comprises a base member in the form of a cup or bowl shaped ball carrying seat structure having a ball retaining wall extending therearound. The wall includes a heightened section extending at least partially around the seat structure. Means are included for attaching the cup shaped structure to the bill of a golfer's headpiece with the heightened section of the ball retaining wall positioned at the distal end of the bill.

The device further includes a ball normally carried in the cup shaped seat structure when the latter is relatively still, and in this regard, the heightened section of the ball retaining wall is of a height to prevent the ball from falling from the seat structure even when the bill of the headpiece is inclined downwardly as it would be during the golfer's address of a ball to be struck. The device could also be varied to include a wedge shaped base so that the base structure is more parallel to the plane of the ground even though the hat bill is angled downwardly toward the plane of the ground. The device may further include a flexible cord attached between the ball and the base member. The cord should be sufficiently long to permit movement of the ball out of the cup shaped seat structure during operation and allow the ball to dangle over the bill of the headpiece to which the device is attached by the attaching means. Further, the wall of the cup shaped seat structure, other than the heightened section thereof, should be of insufficient height to prevent the ball from moving laterally out of the seat structure should the base member be moved laterally sideways or tilted at too great an angle by improper movement of the head, neck and/or shoulders, torso or hips during the golf swing.

The cup shaped seat structure of the golf training device of the invention may have a bottom portion that is a circular flat disc, or alternatively, the bottom portion may present a concave or convex surface. The ball retaining wall should preferably be arcuate, that is, curved from its outer periphery toward the bottom portion. The retaining wall provides an escape route for the ball to leave the seat structure and fall by gravity to dangle in front of the golfer's face should the device be caused to tilt at too great an angle or moved laterally too sharply during the execution of the golf swing.

In an adaptive model of the basic device, the height of the ball retaining wall might be raised through the use of one or more additional wall members provided with the basic device and that can be mounted on the rim of the retaining wall by material such as scotch tape or velcro, or a slip mechanism. This would give the user the ability to vary the depth of the cup shaped seat structure making it easier or more difficult to retain the ball in the seat structure even when making an improper swing, thus helping the user measure his degree of proficiency in developing a correct swing.

In a preferred form of the invention, the cord may be attached between the ball and the front center of the wall. Alternatively, the cord may be attached at another location on the base member, such as, for example, the bottom of the seat structure.

DETAILED DESCRIPTION OF THE PREFERRED EMBODIMENTS

Figure 5:
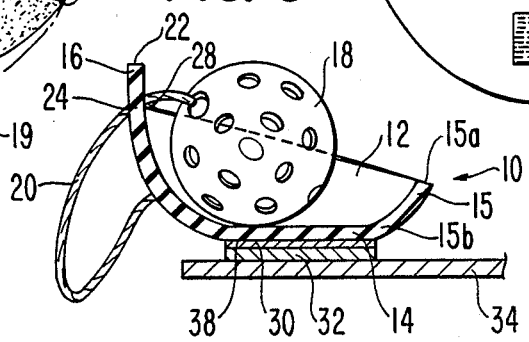
FIG. 5 is a cross-sectional view taken along the line 5—5 of FIG. 2.

A golf training device 10 embodying the concepts and principles of the invention is illustrated particularly in FIGS. 1 through 5 of the drawings. Device 10 includes a base member consisting of a generally bowl or cup shaped ball carrying seat structure 12 having a bottom portion 14 and a wall 15 extending around bottom portion 14. In vertical cross-sectional configuration, as shown in FIG. 5, wall 15 may preferably be curved from its outer periphery 15*a* to its point of connection 15*b* with bottom portion 14, to thereby present the cup or bowl shaped configuration of seat structure 12. Wall 15 includes an elongated, heightened, arcuate wall section 16 which extends partially around seat structure 12 as can be seen in the drawings. As can also be seen, particularly in FIG. 5, wall 15 is integral with the periphery of bottom portion 14.

Device 10 also includes a ball 18 and a flexible cord 20 attached to ball 18. Cord 20 is also affixed to wall 15 at approximately the center of the latter, as shown in the drawings. However, the cord could be fastened to some other area of the device.

Wall section 16 has an upper edge 22 and a lower extremity 24 that, as shown is integral with the remainder of wall 15. Wall section 16 also has a pair of opposed ends 26 and 28. The lower extremity 24 of wall section 16 is longer than the upper edge 22 thereof, and as can best be seen in FIGS. 2 and 5, the ends 26 and 28 of wall 16 may be inclined downwardly from upper edge 22 to the lower extremity 24. As can also be seen in the drawings, and particularly in FIGS. 2 and 5, ends 26 and 28 have an elevational profile which is curved.

Device 10 also includes means in the form of VELCRO elements 30 and 32 (FIG. 4) for attaching the cup shaped base member 12 to the bill 34 of a golfer's headpiece 36, which as illustrated is in the form of a baseball type cap. As would be appreciated by one of ordinary skill in the art to which the invention pertains, VELCRO element 30 may be attached to the bottom 38 of member 12 by an adhesive, for example, while VELCRO element 32 may be attached to bill 34, also by an adhesive or alternatively by sewing or pinning.

Figure 1:
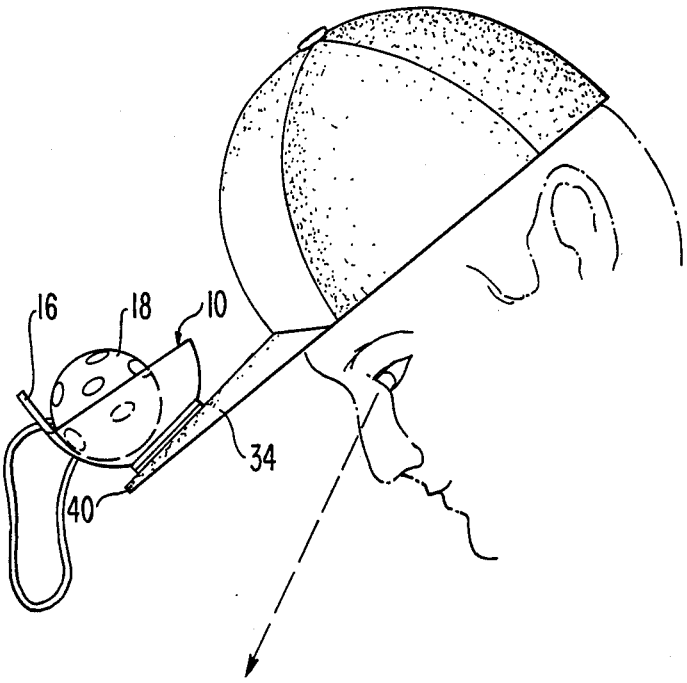
FIG. 1 is an elevational view illustrating the position of the golf training device on the bill of a golfer's headpiece during the address of the ball prior to execution of the golf swing.
Figure 2:
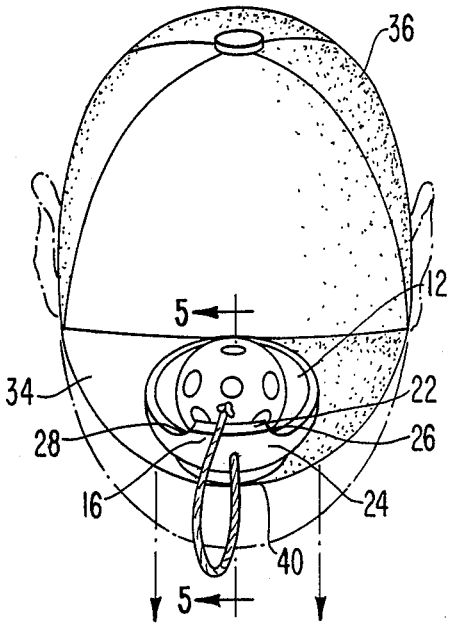
FIG. 2 is a front elevational view of the device and headpiece in the same position as in FIG. 1.
Figure 3:
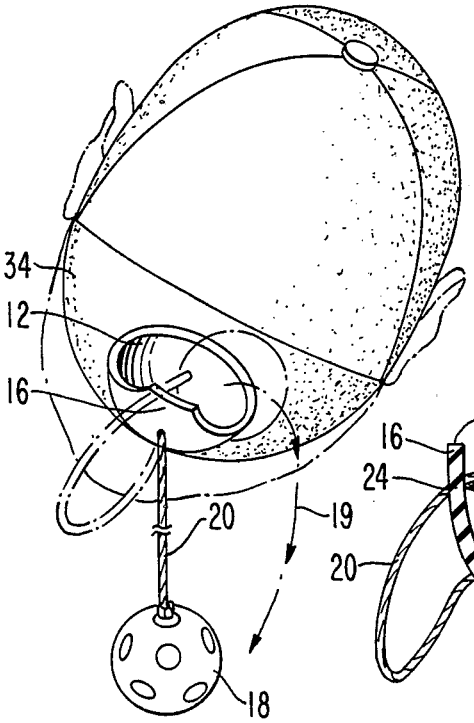
FIG. 3 is a front elevational view similar to FIG. 2 but illustrating the operation of the golf training device upon improper head or neck movement and/or improper movement of the shoulders, torso or hips.
Figure 4:
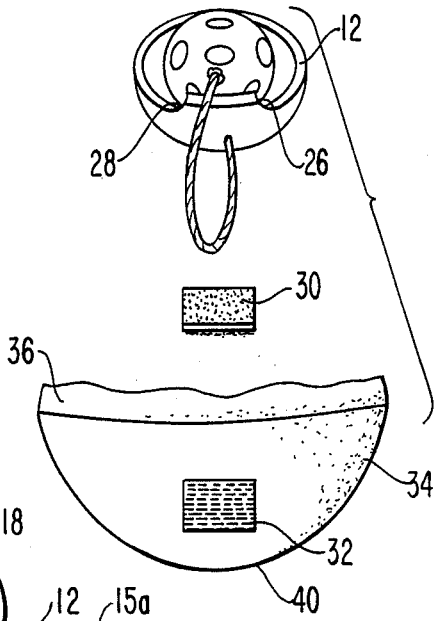
FIG. 4 is an exploded view illustrating the means for attaching the golf training device to the bill of a golfer's headpiece.

The operational positions of device 10 are illustrated particularly in FIGS. 1, 2 and 3, where it can be seen that the device 10 is attached to bill 34 at or near the mid-point of the latter. Device 10 is positioned such that wall section 16 faces the distal end 40 of bill 34. Thus, the heightened wall section 16 is in a position to normally retain ball 18 in seat structure 13 even when ball 18 has moved forward as shown in FIG. 1. Heightened wall section 16 keeps ball 18 from falling from structure 12 so long as the latter remains relatively motionless in a lateral direction and is not tilted sideways at too great an angle to the ground. In this connection, it should be noted that wall section 16 is of a sufficient vertical height to prevent ball 18 from falling from seat structure 12 even when bill 34 is inclined sharply downwardly as shown in FIGS. 1 and 2.

Improper head, or neck movement that may occur during a faulty golf swing, especially when there is improper shoulder, torso and/or hip movement, is illustrated in FIG. 3. Thus, bill 34 of headpiece 36 moves from the position illustrated in FIG. 2 to the position illustrated in FIG. 3. This imposes lateral forces upon ball 18 which tend to move the latter laterally relative to cup shaped base member 12. A head tilted sideways, left or right, in turn tilts device 10 to thus aggravate the forces and induce the ball 18 to move more easily out of seat structure 12. As can be seen from FIG. 3, wall section 16 is of insufficient length to prevent ball 18 from moving laterally out of seat structure 12 when the latter is moved laterally to sharply or tilted at too great an angle by improper head, neck, shoulder, torso or hip movement during the golf swing. Thus, ball 18 leaves seat structure 12 through the forces of inertia and gravity and falls by gravity along the path 19 indicated by arrows in FIG. 3 to assume the position illustrated in FIG. 3 where ball 18 can readily be seen by the golfer who has executed an improper golf swing. To keep the ball 18 in seat structure 12 during the swing, the golfer must keep his head and neck relatively still, aided by rotating his shoulders, torso and hips horizontally. Otherwise ball 18 will leave seat structure 12 to dangle before the golfer's eyes.

To facilitate the operation of the device, cord 20 must be sufficiently long to permit ball 18 to move from seat structure 12 during operation and allow ball 18 to dangle over end 40 of bill 34 as shown in FIG. 3. The curvature of ends 26 and 28 and the inward curvature of wall 15 toward bottom portion 14 are tailored to facilitate lateral movement of the ball upon improper head and neck movement but impede lateral movement of ball 18 when the head and neck remains relatively still.

The shape which is essentially as shown in FIG. 5 has been found to be appropriate for use in connection with a light, plastic, hollow, perforate ball similar to a golf training ball, but is also appropriate for use with an unattached regulation golf ball. However, it should be appreciated that the exact shape of wall 15, wall section 16 and ends 26 and 28 might need to be tailored to fit some other application involving a heavier or larger or smaller ball than the one which is illustrated and described herein. It should also be appreciated that the configuration of bottom portion 14 might be that of a flat disc as shown, or alternatively might be that of a concave or convex surface.

As suggested above, ball 18 might preferably be like a golf practice ball which is of the same size as a regular golf ball but is hollow and light and perforate so that it could be struck by a golf club in a confined area and have a short flight and not endanger property and/or other persons. A bell inside the plastic ball is preferable so that an aural warning may be heard when an improper swing is in process. However, the physical characteristics of the ball are not necessarily a critical part of the present invention, and in fact, all that is required is that the same be capable of moving, through the forces of inertia and gravity, from seat structure 12, upon improper head and neck movement, usually including improper shoulder, torso or hip motion, during the golf swing, and that the same be heavy enough to then fall by gravity to dangle before the eyes of the golfer, or if unattached to the device to fall to the ground.

Seat structure 12 may preferably be formed from a light weight, moldable or otherwise formable material such as plastic. As shown, seat structure 12 is circular and has an internal diameter which is approximately 3' 258 but which could be slightly larger or smaller. The physical characteristics of seat structure 12 has been designed to keep the particular ball 18 either in the seat structure 12 or lying against the elongated distal section 16 of retaining wall 15 during the normal address of a golf ball, and to facilitate lateral movement of ball 18 out of cup shaped seat structure 12 upon improper head, neck and/or shoulder, torso or hip movement during the golf swing.

Figure 6:
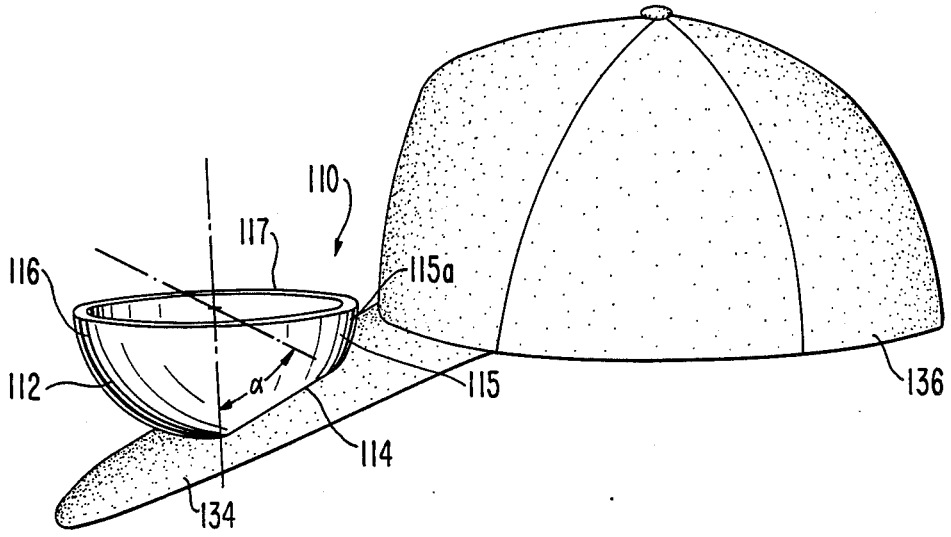
FIG. 6 is a perspective view to illustrate an alternative embodiment of the invention.

An alternative configuration 110 for the device of the invention is illustrated in FIG. 6. The device 110 includes a seat structure 112 that is configured essentially in the shape of a truncated hemisphere. The truncation preferably is such that the angle $\alpha$ in FIG. 6 is approximately 60°. Thus, a generally flat, circular, disc shaped bottom portion 114 and a wall 115 extending around bottom portion 114 are presented. With a hemispherical configuration having a diameter of about 3' bottom portion 114 preferably has a diameter of approximately 1 ¼". As can be seen, the configuration of device 110 also presents a heightened section 116 of wall 115 that extends at least partially around structure 112. Manifestly, all portions of the wall 115 are curved from the upper periphery of the wall and toward bottom portion 114.

Like the device 10, device 110 includes a ball (not shown in FIG. 6) like the ball 18 and a flexible cord (not shown in FIG. 6) like the cord 20 for tethering the ball to the device. Also the device 110 is attachable to the bill 134 of the cap 136 by VELCRO or the like (not shown in FIG. 6) in the same manner as the device 10 is attached to bill 34 in FIGS. 1 through 5. The device 110 preferably may be molded in one piece with bottom portion 114 and wall 115 formed integrally.

As a result of the shape of device 110 as depicted in FIG. 6, the frontal portions of wall section 116 have a greater height relative to bottom portion 114 than do the rearmost portions 115a of the wall 115. Thus, a ball tends to stay in the cup even when the bill of the cap is angled downward toward the ground as during the process of the golf swing. Also, the offset angle of the flat surface 114 relative to the upper rim 117 of the cup 112 keeps rim 117 disposed in a generally horizontal position relative to the ground even when the bill 134 to which the device 110 is attached is inclined downwardly relative to the ground.

The flat bottom portion 114 bill 134, and at the same time provides a resting place for the ball inside the cup 112. Thus, the concepts principles of the invention as embodied in both the device 10 and the device 110 are the same.

We claim:

1. A golf training device for indicating improper head and neck movements, and encouraging proper rotational movement of shoulders, torso and hips during the golf swing, said device comprising:

a generally cup shaped ball carrying seat structure including a central bottom portion and a ball retaining wall extending around the bottom portion, said wall including a frontal section and a pair of oppositely disposed side sections;

means for attaching said structure to the bill of a golfer's headpiece with said frontal section of said retaining wall positioned at the distal end of the bill and with said side sections positioned rearwardly of the frontal section on respective opposite sides of the structure;

a ball normally carried in the seat structure when the structure is relatively still, said frontal section of the wall being of a height to prevent the ball from falling from the seat structure even when the bill of the headpiece is inclined downwardly; and a flexible cord attached between the ball and the seat structure, said cord being sufficiently long to permit lateral or swirling movement of the ball out of the seat structure during operation and allow the ball to dangle over the bill of the headpiece to which the structure is attached by said attaching means, said side sections each having a height that is less than the height of the frontal section and that is insufficient to prevent the ball from moving out of the seat structure should the latter be moved laterally too sharply or tilted sideways at too great an angle to the ground by improper head and neck movement, often activated by improper shoulder, torso or hip action, during a golf swing.

2. A golf training device as set forth in claim 1, wherein said seat structure is generally circular and said frontal wall section is arcuate.

3. A golf training device as set forth in claim 1, wherein said side sections are high enough to retain the ball during a well executed swing, but low enough to allow the ball to escape the device as a result of an improper swing.

4. A golf training device as set forth in claim 3, wherein said frontal section is high enough at the distal end of the bill to retain the ball even when the bill, and thus the seat structure, is angled sharply toward the ground during the address of the ball to be hit and during the entire back through forward swing.

5. A golf training device as set forth in claim 1, wherein said cord is attached between the ball and the center of the frontal section.

6. A golf training device as set forth in claim 1, wherein said wall and said bottom portion are formed integrally.

7. A golf training device as set forth in claim 1, wherein the seat structure is in the shape of a truncated hemisphere presenting said bottom portion and said wall.

* * * * *

UNITED STATES PATENT AND TRADEMARK OFFICE

CERTIFICATE OF CORRECTION

PATENT NO. : 4,936,584

DATED : June 26, 1990

INVENTOR(S) : DAVID W. EWALD and GARY S. WORDEN

It is certified that error appears in the above-identified patent and that said Letters Patent is hereby corrected as shown below:

Front Page [57] Abstract, line 1, "taining" should be --training--.

Column 4, line 52, " 3'" should be --3"--;

line 53, delete "258".

Signed and Sealed this

Twenty-eighth Day of April, 1992

*Attest:*

HARRY F. MANBECK, JR.

*Attesting Officer*

*Commissioner of Patents and Trademarks*